United States Patent [19]

Dorner et al.

[11] Patent Number: 4,712,355

[45] Date of Patent: Dec. 15, 1987

[54] METHOD AND APPARATUS FOR LOADING ARTICLES INTO A CONTAINER

[75] Inventors: Wolfgang C. Dorner, Oconomowoc; Michael A. Hosch, Hartland; Mark C. Wedell, Delafield, all of Wis.

[73] Assignee: Dorner Mfg. Corp., Hartland, Wis.

[21] Appl. No.: 20,395

[22] Filed: Mar. 2, 1987

[51] Int. Cl.[4] ..... B65B 5/04; B65B 5/06

[52] U.S. Cl. ..... 53/443; 53/247; 53/273; 53/260

[58] Field of Search ..... 53/443, 447, 473, 532, 53/540, 542, 247, 248, 251, 260

[56] References Cited

U.S. PATENT DOCUMENTS

| | | | |
|---|---|---|---|
| 3,832,826 | 9/1974 | Ullman | 53/247 X |
| 4,316,354 | 2/1982 | Loewenthal | 53/247 X |
| 4,329,831 | 5/1982 | Warkentin | 53/247 X |
| 4,398,383 | 8/1983 | Prakken | 53/247 X |
| 4,457,121 | 7/1984 | Johnson et al. | 53/248 X |
| 4,478,024 | 10/1984 | Vedvik et al. | 53/260 X |
| 4,520,614 | 6/1985 | Aykut et al. | 53/247 X |
| 4,522,011 | 6/1985 | Bauers et al. | 53/247 X |
| 4,569,181 | 2/1986 | Raudat | 53/247 X |
| 4,660,352 | 4/1987 | Deines et al. | 53/247 X |

*Primary Examiner*—Horace M. Culver

*Attorney, Agent, or Firm*—Andrus, Sceales, Starke & Sawall

[57] ABSTRACT

A method and apparatus for loading articles into a container. The articles, in the form of a side-by-side stack of small trays or boxes, are conveyed along a conveyor and are discharged into a bin, which is mounted for pivoting movement between an article receiving position, in which the base of the bin is located at an acute angle to the horizontal, to a discharge position where the base is disposed generally vertical. The stack of articles received within the bin is supported against a movable end wall, and clamping means is provided to clamp the stack laterally against a side wall of the bin, as well as clamping the stack against the base. With the stack clamped in the bin, the bin is then rotated to the discharge position and the movable end wall is moved to a release position. The bin is then lowered to lower the stack into a container, and on release of the clamping mechanism the stack is discharged into the container.

20 Claims, 8 Drawing Figures

FIG. 5
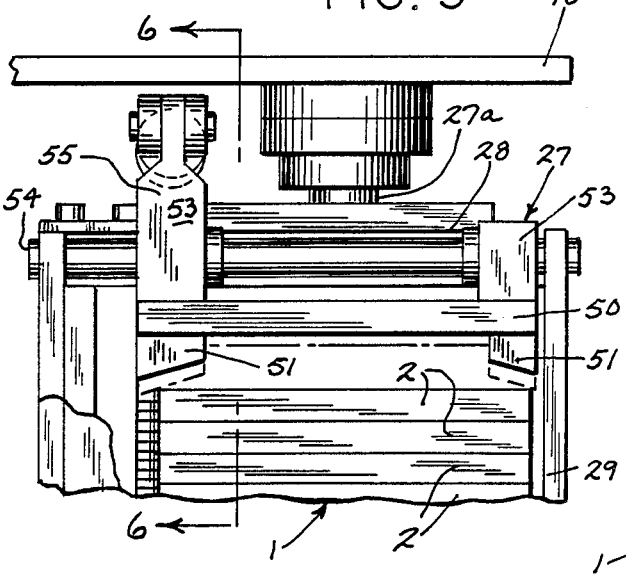
FIG. 6
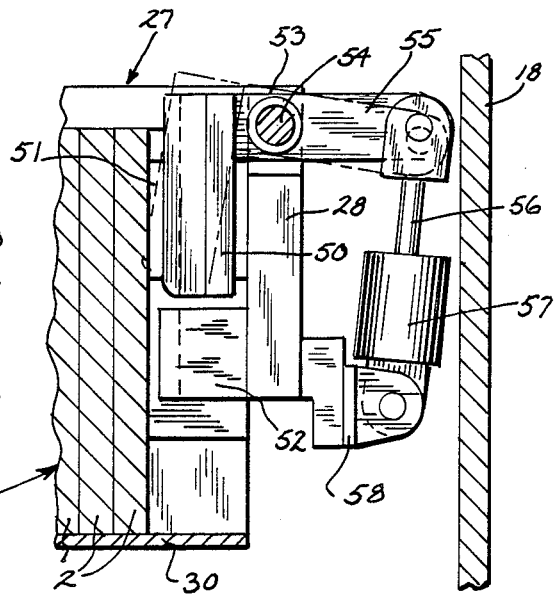
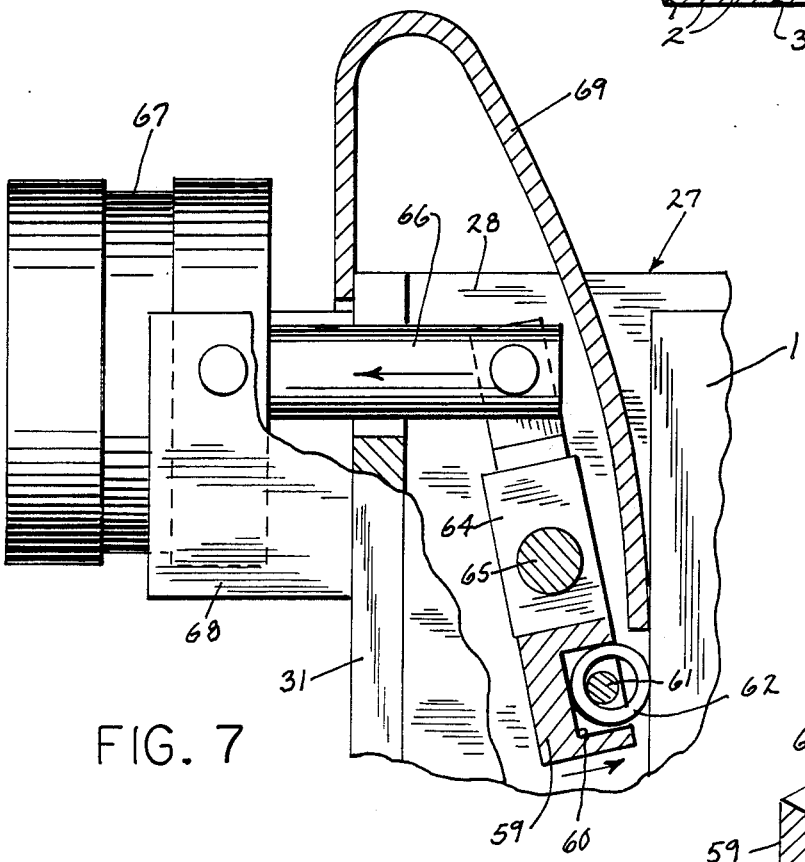
FIG. 7
FIG. 8
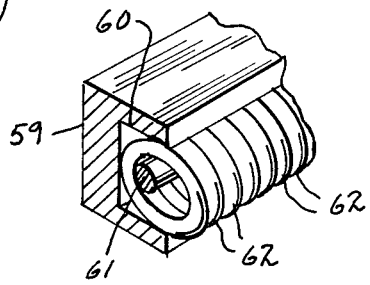

METHOD AND APPARATUS FOR LOADING ARTICLES INTO A CONTAINER

BACKGROUND OF THE INVENTION

Hinged containers or boxes are frequently used to contain small products, such as compact recording discs, coin collections, and the like. The typical container is formed of two open top molded plastic trays or sections and each section has integrally molded hinge elements which are snap fitted with hinge elements on the other section to form the hinged container.

It is desirable to have a programmed assembly system in which the container sections are automatically joined together, folded to a closed condition, stacked in side-by-side relation and then loaded into a container. An automated system of this type will greatly reduce the manual labor normally involved in handling, stacking and loading a multiplicity of containers.

SUMMARY OF THE INVENTION

The invention is directed to a method and apparatus for loading a stack of articles into a container. In accordance with the invention, a series of small boxes or containers, stacked in side-by-side relation, are conveyed on a conveyor and discharged from the conveyor into a bin or article receiving means. The bin is formed with a base or bottom wall and a movable end wall, and the bin can be rotated between an article receiving position, in which the bin extends downwardly and outwardly from the downstream end of the conveyor at an acute angle to the horizontal, to a discharge position where the base extends generally vertically.

The stack of articles is fed from the conveyor and slides along the base into engagement with the end wall. Clamping mechanisms are associated with the bin and act to clamp the stack laterally against a fixed side of the bin, as well as clamping the stack against the base.

The bin is then rotated from the receiving position to the discharge position and the movable end wall is moved to a release position, so that the lower end of the clamped stack is unsupported.

The bin is then lowered to position the lower end of the stack in a container and by release of the clamping mechanisms the stack is deposited into the container.

The invention serves to automatically load a stack of articles from a conveyor into a container or box and thereby eliminates the manual labor normally associated with such operation.

Other objects and advantages will appear in the course of the following description.

DESCRIPTION OF THE DRAWINGS

The drawings illustrate the best mode presently contemplated of carrying out the invention.

In the drawings:

FIG. 5 is an enlarged fragmentary top plan view showing the mechanism for clamping the stack against a side wall of the base;

FIG. 6 is a section taken along line 6—6 of FIG. 5;

FIG. 7 is an enlarged fragmentary side elevation of the bin with parts broken away; and FIG. 8 is a fragmentary perspective view of the clamping bar.

DESCRIPTION OF THE ILLUSTATED EMBODIMENT

Figure 1:
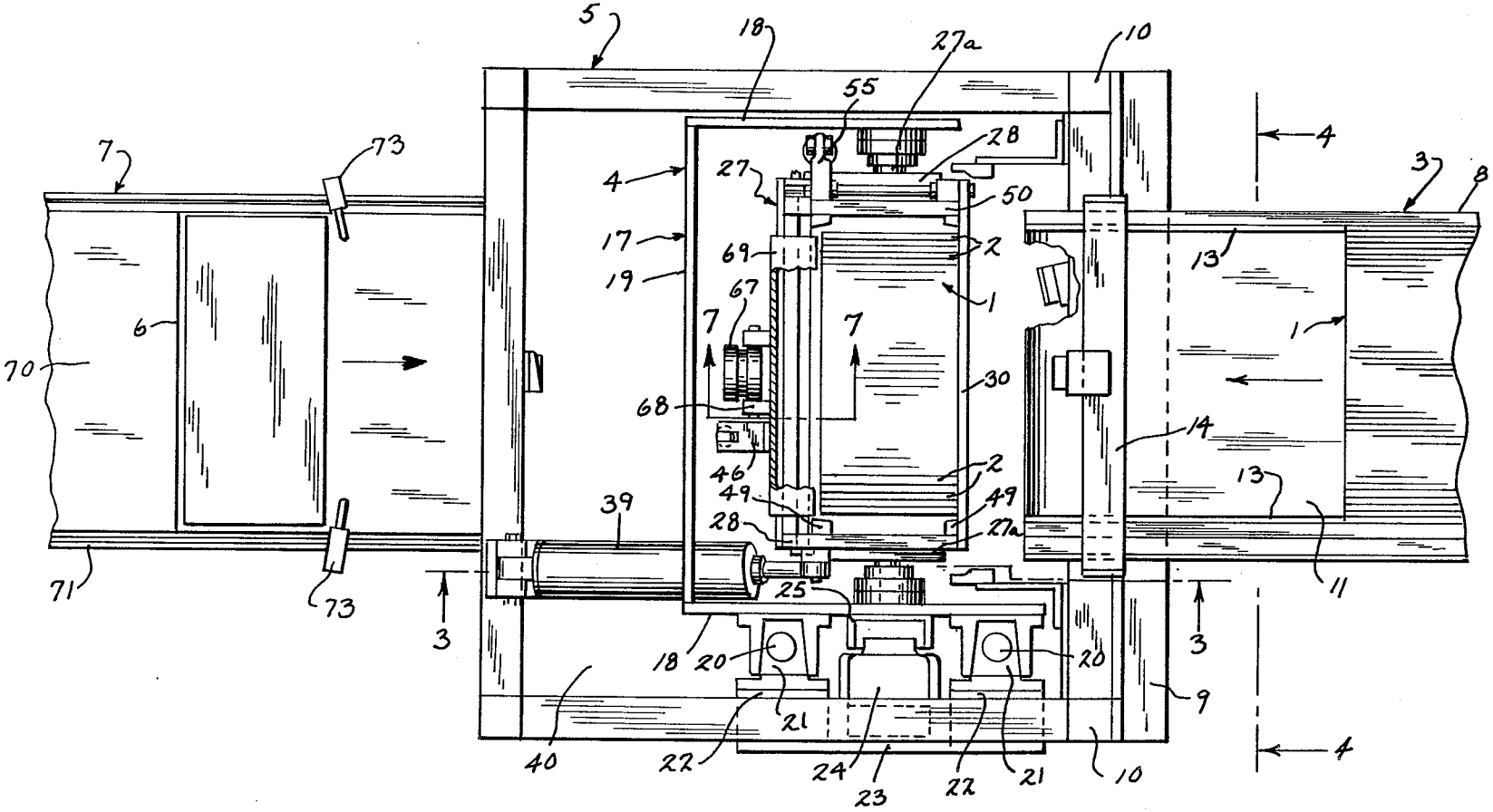
FIG. 1 is a top plan view of the apparatus of the invention.
Figure 2:
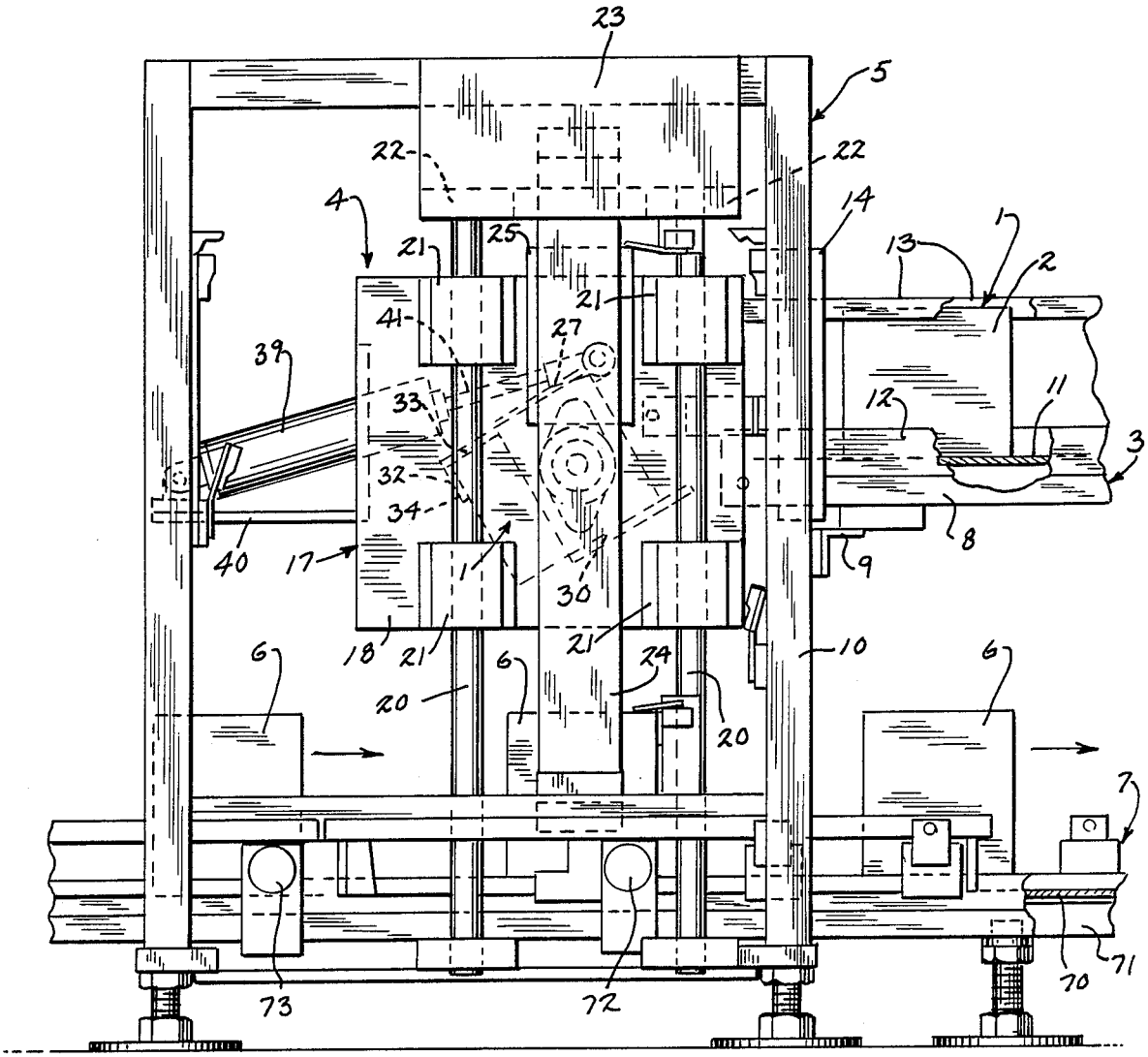
FIG. 2 is a side elevation of the apparatus.

The drawings illustrate an apparatus for loading articles into a container. As shown in FIGS. 1 and 2, a stack 1 of articles 2, disposed in side-by-sude relation, are transported on a conveyor 3 and the stack is fed into a loading unit 4 which is carried by a generally box-like frame 5. The stack 1 is then discharged from loading unit 4 into a container or box 6, which is supported on a second conveyor 7 located at a lower level than conveyor 3.

As illustrated in the drawings, the articles 2 are thin plastic containers or trays adapted to hold small artciles, such as, for example, compact recording discs, coin collections, or the like. While the invention has particular use for loading a stack of articles into a container, it can also be employed to load single articles or products into a container.

Conveyor 3 is composed of a frame 8, which is supported on a cross angle 9, which extends between vertical legs 10 of frame 5. Conveyor 3 includes a belt 11 which is mounted for endless travel on frame 8.

Figure 4:
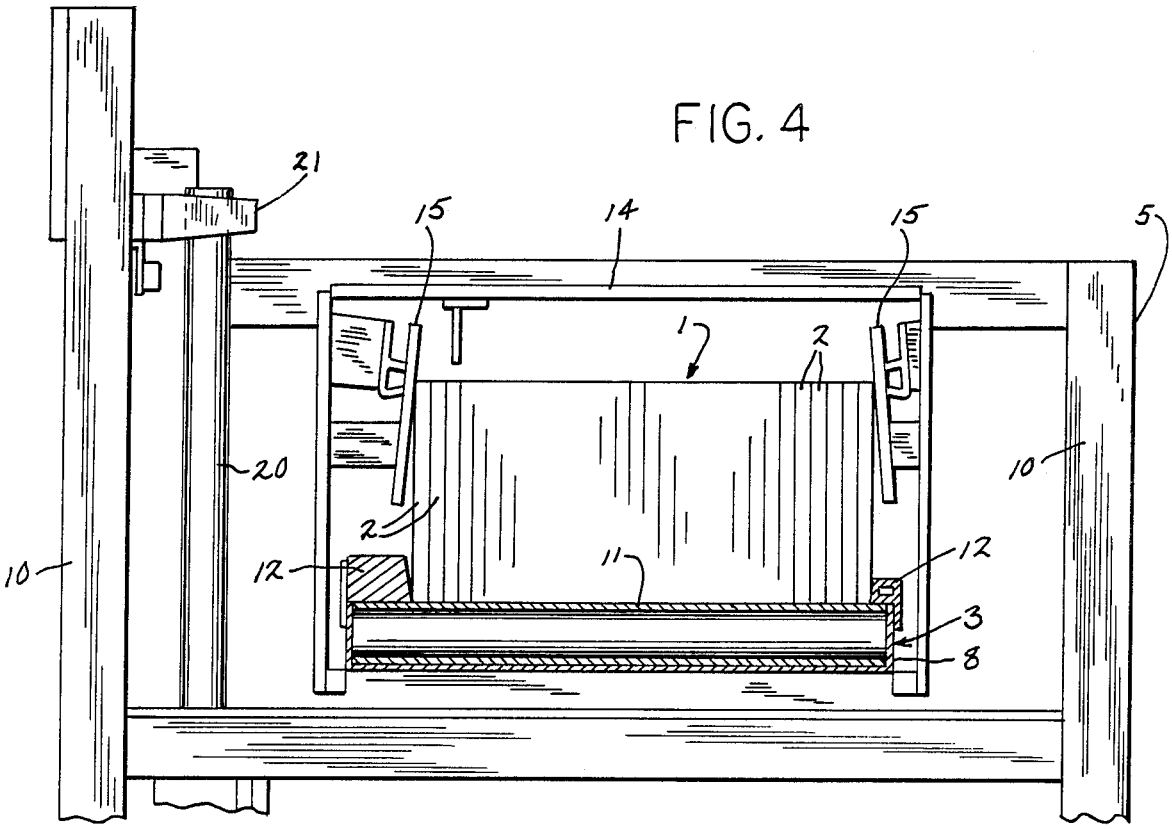
FIG. 4 is a section taken along line 4—4 of FIG. 1.

Stack 1 of articles 2 is guided in travel on belt 11 by a pair of spaced lower guides 12 and a pair of upper spaced guides 13 which are supported from an arch 14. Arch 14 is supported by frame 8 and extends upwardly over belt 11. In addition, a pair of spaced guide plates 15 project downstream from arch 14 and serve to guide the stack, as it is moved into the loading unit 4, as best shown in FIG. 4.

Loading unit 4 includes a carriage 17 that is mounted for vertical movement relative to frame 5. Carriage 17 is composed of a pair of side plates 18 connected at their rear edges by rear plate 19. To mount carriage 17 for vertical movement, a pair of guide rods 20 is secured to each side of frame 5, and a pair of bearing blocks 21 are mounted on the outer surface of each side plate 18 and are adapted to slide on each guide rods 20. The upper ends of each pair of guide rods 20 are connected through brackets 22 to plates 23 that are attached to frame 5, as shown in FIGS. 1 and 2.

A band cylinder 24 is mounted vertically on frame 5 and a carrier 25, which is connected to a piston, not shown, slidable in cylinder 24, is connected to one of the side plates 18. By introducing fluid into opposite ends of cylinder 24, carrier 25 will be moved vertically along the cylinder to thereby move carriage 17 vertically relative to frame 5.

The stack 1 of articles 2 moving on conveyor 3 is discharged by gravity into an article receiving means or bin 27, which is mounted for pivotal movement with respect to carriage 17. Bin 27 includes a pair of spaced side plates 28, a base 30 which connects the lower edges of side plates 28, and a top plate 31 that extends across the top edges of plates 28.

In addition, bin 27 is provided with a movable, L-shaped, end member 32 composed of a pair of legs 33 and 34. Leg 33 carries a pair of lugs 35 which are journalled on shaft 36 that extends between side plates 28. See FIG. 3. Bin 27 can be pivoted between an article receiving position, as shown in FIG. 2, in which base 30 extends at an angle of about 30° to the horizontal, to a discharge position where base plate 30 extends substantially vertically and leg 34 of end member 32 is located beneath stack 1, as shown in FIG. 3.

As the stack 1 is moved from conveyor 3 it is guided between guide plates 15 and the stack slides downwardly along the inclined base 30 into contact with leg 34. After stack 1 is clamped within the bin, as will be described hereinafter, bin 27 is rotated to the position shown in FIG. 3, in which base 30 extends upwardly and the projecting end 37 of the base is received within notches 38 formed in guide plates 15. Bin 27 is journalled for rotation with respect to carriage 17 by stub shafts 27*a*.

To pivot the bin 27 between the receiving and discharge positions, a cylinder 39 interconnects bin 27 with carriage 17. Cylinder 39 extends through an opening in rear wall 19 of carriage 17 and the rear end of the cylinder is pivotally connected to lugs on plate 40 that is secured to wall 19. A piston rod 41, which is slidable within cylinder 39, is connected through clevis 42 to a bracket, which is attached to one of the side plates 28 of bin 27. When the bin is in the receiving position, as shown in FIG. 2, piston rod 41 is extended and by retracting the piston rod, bin 27 can be pivoted to the discharge position, as illustrated in FIG. 3.

Figure 3:
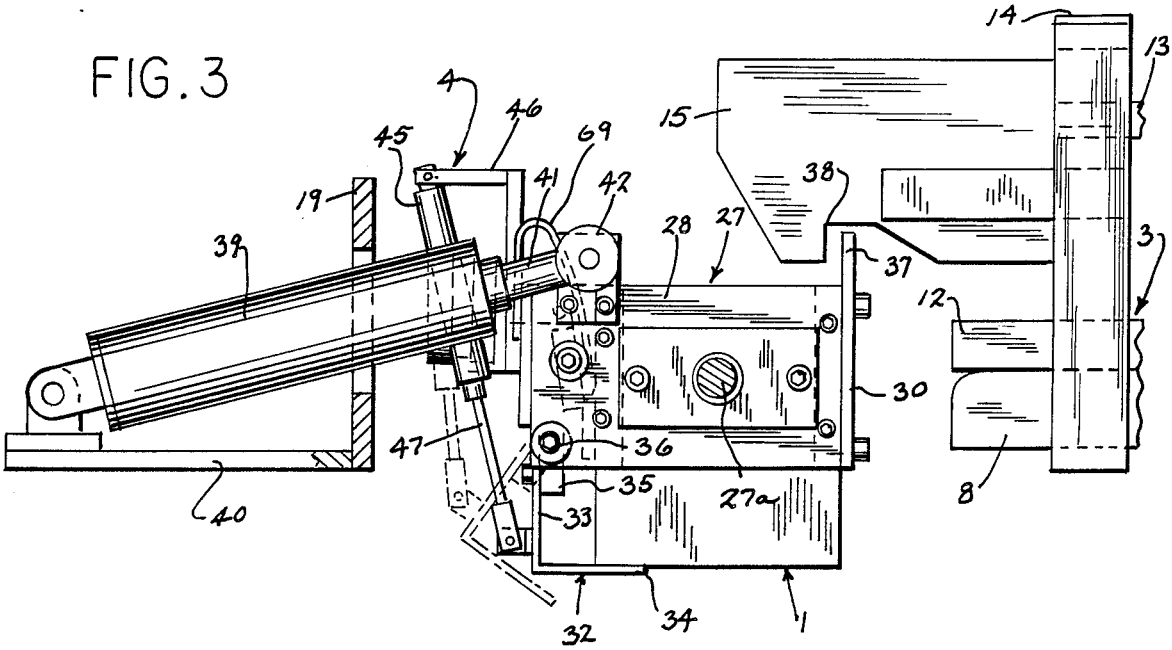
FIG. 3 is a verticla section taken along line 3—3 of FIG. 1 showing the bin in the discharge position.

End member 32 is constructed to be pivoted between a supporting position, as shown by the full lines in FIG. 3, and a release position, as shown by the dashed lines in FIG. 3. To provide this pivoting action, one end of fluid cylinder 45 is connected to an L-bracket 46 attached to plate 31, while the piston rod 47 of cylinder 45 is pivotally connected to a lug that projects outwardly from leg 33 on member 32, as shown in FIG. 3. By introducing fluid into the lower end of cylinder 45, piston rod 47 will be retracted to move member 32 from the supporting position to the release position.

As best shown in FIG. 1, one of the side plates 28 of bin 27 is provided with a pair of spaced vertical guide strips 49, formed of nylon or the like, and a clamping mechanism is employed to clamp the stack 1 laterally against the strips 49. To provide this clamping action, a pivotable clamping wall 50 is located inwardly of the respective side plate 28 and the side edges of wall 50 carry vertical guide strips 51. In addition, a fixed guide bar 52 is located beneath guide strips 51 and is anchored to side plate 28, as illustrated in FIG. 6.

To mount clamping wall 50 for pivoting movement, bushings 53 are connected to the upper edge of clamping wall 50 and the bushings are positioned within notches in the upper end of side plate 28, as shown in FIG. 6, and are journalled on a pivot shaft 54. An arm 55 is connected to one of the bushings 53 and extends outwardly from the side plate 28. The outer end of arm 55 is pivotally connected to the upper end of a piston rod 56, which is slidable within a fluid cylinder 57. The lower end of cylinder 57 is pivoted to a bracket 58 that extends outwardly from side plate 28. By introducing fluid into the upper end of cylinder 57, piston rod 56 will be retracted causing arm 55 to pivot around shaft 54 and move the wall 50 inwardly against the end of stack 1, clamping the stack against the opposite side plate 28.

A second clamping mechanism is utilized to clamp stack 1 against base 30. This clamping mechanism takes the form of a clamping bar 59 that extends laterally between side plates 28 and the forward edge of bar is provided with a recess or groove 60 which receives a rod 61 supporting a multiplicity of resilient O-rings 62. O-rings 62 are disposed in contact with each other and extend the entire length of rod 61, as illustrated in FIG. 8. While the drawings illustrate the resilient covering for clamping bar 60 to be in the form of a plurality of O-rings 62, it is contemplated that an elongated resilient tube or a resilient bar could also be used.

A vertical arm 64 is connected to the central portion of clamping bar 60 and the central portion of bar 64 is pivoted about shaft 65, which extends between side plates 28. To pivot arm 64 and correspondingly bring the O-rings 62 of clamping bar 60 into engagement with the edges of articles 2 in stack 1, a piston rod 66 of fluid cylinder 67 is pivotally connected to the upper end of arm 64. Cylinder 67 is connected through brackets 68 to plate 31 of bin 27, as shown in FIG. 7. By retracting piston rod 66, clamping bar 60 will be brought into contact with the edges of the articles 2 in stack 1, forcing the stack against base 30. O-rings 62 provide a resilient surface which accommodates any surface unevenness on the edge of the stack and insures that the edge of each article 2 in stack 1 will be firmly engaged.

To aid in guiding the stack 1 into bin 27, a generally U-shaped sheet metal guide 69 is connected to plate 31 and the free end of guide 69 extends inwardly to a location adjacent the clamping bar 60. The curved surface of the guide 69 aids in guiding the stack 1 into proper position in bin 27.

Conveyor 7 is a conventional type, including an endless belt 70, which is mounted for travel on frame 71. Containers 6 are conveyed on belt 70 and stop assemblies 72 and 73, which can be constructed, as described in U.S. Pat. No. 4,487,309 can be located above the belt 70, as shown in FIG. 2. Stop assembly 72, when moved to the obstructing position, will stop a container 6 on the moving belt in a position directly in alignment with bin 27, so that the stack can be discharged into the container, while stop assembly 73 is located upstream of stop 72 and will stop the next succeeding container 6 in a ready position.

In operation, each stack 1 is conveyed on conveyor 3 and as it travels to the discharge end of conveyor 3, it is guided by plates 15 into the bin 27, which is in the article receiving position, as shown in FIG. 2. The stack 1 will slide down base plate 30 into engagement with the movable end member 32. Cylinder 57 is then actuated to move the clamping wall 50 laterally inward to clamp the stack against the fixed side plate 28, and cylinder 67 is then operated to move the clamping bar 60 inwardly and clamp the stack against base 30.

With the stack clamped within bin 27, cylinder 39 is operated to rotate the bin to the position shown in FIG. 3, in which base 30 is substantially vertical and the protruding end 37 of base 30 moves into the notches 38 of guide plates 15.

With the bin in the discharge position, cylinder 45 is then actuated to move the L-shaped end member 32 to the release position, as shown by the dashed lines in FIG. 3. Cylinder 24 is then operated to move the carriage 17 downwardly, causing the lower end of the stack to be fed into the upper end of the container 6, which is held on the moving belt 70 by stop assembly 72. At the end of the stroke of cylinder 24, the lower end of stack 1 will be spaced slightly above the bottom of container 6. The clamping cylinders 57 and 67 are then operated to release the stack, enabling the stack to fall downwardly by gravity into engagement with the bottom of the container 6. Stop assembly 72 is then withdrawn to release the filled container and simultaneously stop 73 is released to enable the next succeeding container to move into position beneath the bin 27.

In normal operation, conveyor 3 does not operate continuously but is operated only when a stack is fed onto the upstream end of the conveyor. However, if there is a problem or malfunction downstream which prevents the loading apparatus of the invention from accepting a stack, conveyor 3 can be used to store or accumulate a group of stacks. In this regard, each stack, as it is received on conveyor 3, will be conveyed a short distance downstream by momentary operation of the conveyor so that a group of stack can be accummulated on the conveyor without feeding a stack to the loading apparatus.

The invention provides a mechanism for automatically guiding a stack of articles and loading the articles into a container which eliminates the manual labor normally associated with loading a multiplicity of articles into a container or box.

Various modes of carrying out the invention are contemplated as being within the scope of the following claims particulary pointing out and distinctly claiming the subject matter which is regarded as the invention.

I claim:

1. An apparatus for feeding an article into a container, comprising article receiving means having an open end to receive an article and having a second end, movable closure means for closing said second end and movable between a first closed position where said closure means is disposed to be engaged by an article being received within said open end to a second open position, operating means for moving said closure means between the closed and open positions, mounting means for mounting said article receiving means for rotation about a horizontal axis from an article receiving position to a discharge position where said second end faces downwardly, means for moving said article receiving means between the receiving position and the discharge position, clamping means for clamping the article within the article receiving means, and release means for releasing the clamping means after said closure means has been moved to said open position to thereby permit said article to be discharged from said article receiving means through said second end.

2. An apparatus for feeding an article into a container, comprising conveyor means for conveying an article, article receiving means disposed adjacent the downstream end of said conveyor means and having a first open end and a second end disposed opposite said first end, means for mounting the article receiving means for pivotal movement from a receiving position where said first end is disposed adjacent said downstream end of said conveyor means to a discharge position where said second end faces downwardly, closure means for opening and closing said second end, said closure means being in a closed position when said article receiving means is in said receiving position so that the article being received in said article receiving means will engage said closure means, operating means for moving said closure means between the closed and open positions, clamping means for clamping the article within the article receiving means, lowering means for lowering the article receiving means downwardly to a position where said article is at least partially disposed within a container, and means for releasing said clamping means after movement of said closure means to the open position to permit said article to fall by gravity from said receiving means into said container.

3. The apparatus of claim 2, wherein said article receiving means has a base extending between said first and second ends, said closure means when in the closed position being disposed generally normal to said base.

4. The apparatus of claim 2, wherein said base extends downwardly from said conveyor means at an acute angle when said article receiving means is in the receiving position.

5. The apparatus of claim 2, wherein said closure means is pivoted to said article receiving means.

6. The apparatus of claim 1, wherein said article receiving means has a fixed side wall, and said clamping means is constructed and arranged to clamp the article against said fixed side wall.

7. The apparatus of claim 1, wherein said article receiving means has a pair of opposed side walls extending between said first and second ends, pivotal means for connecting one of said side walls to said article receiving means for pivotal movement in a direction toward and away from the opposite side wall, and means for actuating said pivotal means to move said one side wall in a direction toward the other side wall to clamp said article against said other side wall.

8. An apparatus for feeding a stack of articles disposed in side-by-side relation into a container, comprising a conveyor to convey said stack, a bin having an open end to receive said stack and having an opposed second end, said bin also having a base extending between said first and second ends, said bin being movable between a receiving position where said open end is disposed adjacent the downstream end of said conveyor and said base is disposed at an acute angle to the horizontal to a discharge position where said second end faces downwardly, first drive means for moving said bin between the receiving and discharge positions, closure means connected to said bin and movable from a closed position where said closure means closes off said second end to an open position, second drive means for moving said closure means between said open and closed positions, clamping means for clamping the stack within the bin, a container disposed beneath the bin, lowering means for lowering the bin after the bin has been moved to the discharge position to lower the stack into said container, and release means for releasing said clamping means after said closure means has been moved to the open position to discharge said stack into said container.

9. The apparatus of claim 8, wherein said bin has a fixed side wall and said clamping means is constructed and arranged to clamp the stack against said fixed side wall.

10. The apparatus of claim 9, wherein said bin has a pair of opposed side walls extending between said first and second ends, means for mounting one of said side walls for movement in the direction toward and away from the other of said side walls, and means for moving said one side wall in a direction toward the other side wall to clamp said article against said other side wall.

11. The apparatus of claim 8, wherein said bin has a pair of opposed side walls extending between said first and second ends, and said clamping means comprises a clamping bar extending between said side walls, said bin also having a base extending between said first and second ends, means for mounting said clamping bar for movement in a direction toward and away from said base, and third drive means for moving said clamping bar in a direction toward said base to clamp the stack against said base.

12. The apparatus of claim 11, and including a resilient covering disposed on said clamping bar and positioned to engage said stack.

13. The apparatus of claim 12, wherein said resilient covering comprises a plurality of axially aliqned resilient O-rings.

14. The apparatus of claim 8, wherein said closure means is pivoted to said bin.

15. The apparatus of claim 14, wherein said closure means is generally L-shaped in cross section and includes a first leg pivotally connected to said bin and a second leg disposed normal to said first leg, said second leg disposed to close off said second end when said closure means is in the closed position.

16. A method for loading a stack of articles disposed in side-by-side relation into a container, comprising the steps of forming a side-by-side stack of articles with each article being elongated in a vertical direction, conveying the stack on a conveyor toward a loading bin having a forward open end and a rear end disposed to be closed by a movable closure, discharging the stack from said conveyor into said bin, while maintaining said closure in a closed position, clamping the stack within the bin, rotating the bin to position said rear end downwardly, moving the closure to an open position where it will not interfere with downward movement of said stack from said bin, positioning a container beneath the bin, releasing the clamping means, and discharging said stack into said container.

17. The method of claim 16, and including the step of lowering the bin after said closure member has been moved to the open position to partially dispose said stack within said container.

18. The method of claim 16, wherein said bin has a base extending between said ends, and including the step of disposing the base at a downwardly inclined angle with respect to the downstream end of said conveyor whereby the stack will be discharged from said downstream end and travel along said base into engagement with said closure.

19. The method of claim 16, wherein the bin has a pair of opposed sides and said step of clamping the stack comprises clamping the stack laterally against one of said sides.

20. The method of claim 16, wherein said bin includes a base extending between said ends and said step of clamping the stack comprises clamping the stack against said base.

* * * * *

UNITED STATES PATENT AND TRADEMARK OFFICE

CERTIFICATE OF CORRECTION

PATENT NO. : 4,712,355

DATED : December 15, 1987

INVENTOR(S) : WOLFGANG C. DORNER ET AL

It is certified that error appears in the above-identified patent and that said Letters Patent is hereby corrected as shown below:

Col. 6, CLAIM 11, Lines 62-64, delete "said bin also having a base extending between said first and second ends,"; Col. 7, CLAIM 13, line 5, Cancel "aliqned" and substitute therefor ---aligned---, Col. 7, line 22, After "bin" delete "," (Comma).

Signed and Sealed this

Twenty-ninth Day of November, 1988

*Attest:*

DONALD J. QUIGG

*Attesting Officer*

*Commissioner of Patents and Trademarks*